US005582354A

United States Patent [19]

Peters

[11] Patent Number: 5,582,354

[45] Date of Patent: Dec. 10, 1996

[54] CHEESE-PRODUCING TEXTILE MACHINE

[75] Inventor: Rainer Peters, Krefeld, Germany

[73] Assignee: W. Schlafhorst AG & Co., Moenchengladbach, Germany

[21] Appl. No.: 436,739

[22] Filed: May 8, 1995

[30] Foreign Application Priority Data

May 26, 1994 [DE] Germany ..... 44 18 339.9

[51] Int. Cl.[6] ..... B65H 54/02; D01H 9/14; D01H 13/26

[52] U.S. Cl. ..... 242/35.5 A; 57/264; 57/281

[58] Field of Search ..... 242/35.5 A, 35.5 R; 57/281, 270, 261, 263, 264

[56] References Cited

U.S. PATENT DOCUMENTS

| | | | |
|---|---|---|---|
| 4,598,881 | 7/1986 | Lattion | 242/35.5 A |
| 4,821,504 | 4/1989 | Shinkai et al. | 242/35.5 A X |
| 4,823,544 | 4/1989 | Igel | 57/264 X |
| 4,844,358 | 7/1989 | Kamp | 242/35.5 A X |
| 4,865,260 | 9/1989 | Colli et al. | 242/35.5 A |
| 4,928,475 | 5/1990 | Matsui et al. | 57/281 X |
| 5,168,695 | 12/1992 | Stahlecker | 57/281 |
| 5,189,872 | 3/1993 | Mima et al. | 57/270 X |

FOREIGN PATENT DOCUMENTS

| | | | |
|---|---|---|---|
| 0262726 | 4/1988 | European Pat. Off. | 242/35.5 A |
| 0410019A1 | 1/1991 | European Pat. Off. . | |
| 3819873C2 | 12/1988 | Germany . | |
| 4017303 | 12/1991 | Germany | 242/35.5 A |
| 4038970A1 | 6/1992 | Germany . | |

*Primary Examiner*—Michael R. Mansen
*Attorney, Agent, or Firm*—Shefte, Pinckney & Sawyer

[57] ABSTRACT

A textile winding machine has a plurality of winding stations and a servicing device which travels along the winding stations. The winding stations are connected with an empty tube magazine disposed at the end of the machine via a conveyor extending along the machine. A manipulating device is provided at each winding station for transferring an empty tube into an intermediate tube storage location of the winding station. The manipulating device has a tube gripper pivotable between a tube pick-up position at the conveyor and a tube release position at the intermediate storage location. The servicing device replaces cheeses which have attained a predetermined diameter with empty tubes by transferring an empty tube out of the intermediate storage location of the respective winding station. In the process, the fill state of the intermediate storage location is monitored by a sensor system installed on the cheese changing servicing device. The presence or absence of an empty tube at a winding station storage location as detected by the sensor system is transmitted inductively to a respective computer or controller of the winding station. A central computer of the winding machine is connected with the respective winding station computers and initiates control of the empty tube magazine for delivery of an empty tube needed at the respective winding station.

5 Claims, 7 Drawing Sheets

CHEESE-PRODUCING TEXTILE MACHINE

FIELD OF THE INVENTION

The present invention relates to a textile machine which produces packages of yarn known as cheeses, having a plurality of identical work stations each equipped with an intermediate empty tube storage, having a servicing device which is movable along the work stations and automatically exchanges finished cheeses for empty tubes, and having a central tube magazine as well as a conveying device extending over the length of the machine for bringing tubes to the work stations serviced by the servicing device.

BACKGROUND OF THE INVENTION

A bobbin winding machine with a cheese changer and a magazine for empty tubes disposed at the end of the winding machine is known from European Patent Publication EP 0 262 726 A. The empty tube magazine is connected with the winding stations via a conveyor arrangement extending over the length of the machine. When required, i.e., for a cheese change, a servicing device is positioned in front of the appropriate winding station and orders a fresh empty tube from the empty tube magazine, which it takes from the conveyor with the help of a gripper arm and then inserts it into the bobbin frame by means of a transfer device. It is further known to separate the servicing device and the tube conveying device functionally as much as possible.

In a system described in German Patent Publication P 43 28 033.1, each winding station has a manipulating device which can be pivoted into the area of the tube conveying system. This system consists of a sturdy, essentially maintenance-free tube gripper which is pivotable in a defined way by means of a pneumatic drive system between a tube pick-up position in the area of the conveying system and a tube release position in the area of an intermediate storage device which is part of the winding station. The storage state of the intermediate storage device is monitored by sensors, for example a light scanner. The sensors of the individual winding stations are connected via the central control unit of the textile machine with the control unit of the tube magazine, so that an empty tube can be requested when needed from the empty tube magazine disposed at the end of the machine.

SUMMARY OF THE INVENTION

Based on the above described prior art, it is an object of the present invention to provide further improvements of yarn winding systems of the basic type initially described above.

This object is attained in accordance with the present invention in a textile machine for producing cheeses of the type comprising a plurality of work stations, each equipped with an empty tube storage location, a traveling servicing device movable along the work stations and having means for automatically exchanging finished cheeses with empty tubes, a tube storage magazine, and a conveyor extending lengthwise along the machine for transporting tubes to the work stations supplied by the servicing device. In accordance with the present invention, the traveling servicing device has a contactless sensor means for monitoring the fill state of the empty storage locations and the sensor means is connected with a signal transmitter for transmitting the fill state to the tube storage magazine.

The described design of the present invention has the particular advantage that only a single sensor device per cheese changer is required for monitoring all intermediate storage locations of the winding stations, in contrast to the prior art wherein light scanners are disposed in the area of each winding station and associated relatively elaborate wiring is disposed in the superstructure of the machine, which can now be omitted.

The cheese changer only initiates execution of a tube exchange operation at a winding station if the presence of a tube in the intermediate storage location has been detected by means of the sensor means of the traveling servicing device. It is possible in this manner to dependably avoid false changes on account of the lack of a tube. Since scanning of the intermediate storage location as well as the information transfer can take place during the movement of the cheese changing servicing device, unnecessary stops of the cheese changer are prevented, so that the availability of the servicing device to the multiple winding stations is extremely high.

The use of an individual computer or like controller already present at each winding station to accomplish the information transfer process has the principal advantage of making cost-effective use of the existing hardware. A trouble-free supply of the winding stations with empty tubes is assured by means of the appropriate modification of the respective software of the control systems involved (i.e., the respective control systems of the cheese changer, the winding station computers, and the winding machine's central computer). In particular, a definitive reliable association of the requested empty tube with the respective winding station can be realized without additional outlay of expense.

In a preferred embodiment, the sensor system of the traveling servicing device is embodied as a light scanner which is fastened on the servicing device by means of a supporting angle bracket to be properly oriented to check the fill state of the individual intermediate storage locations of the winding stations during normal traveling movements of the servicing device along the machine. In this case, the data transfer from the mobile servicing device to the winding station computers disposed stationarily thereat takes place in a contactless way and is therefore not subject to wear.

In an advantageous embodiment of the invention, the light scanner or other sensor device of the cheese changing servicing device is connected via a signal line to the on-board control unit thereof. The control unit of the cheese changer itself in turn is connected with transmitting magnets, which transmit the information determined by the light scanner inductively to a receiving sensor system disposed at each of the winding stations and connected with the respective winding station computer. The winding station computers process the information and forward it, along with the appropriate winding station identification, to the central computer of the bobbin winding machine, which thereupon activates the control of the empty tube magazine.

DETAILED DESCRIPTION OF THE PREFERRED EMBODIMENT

Figure 1:
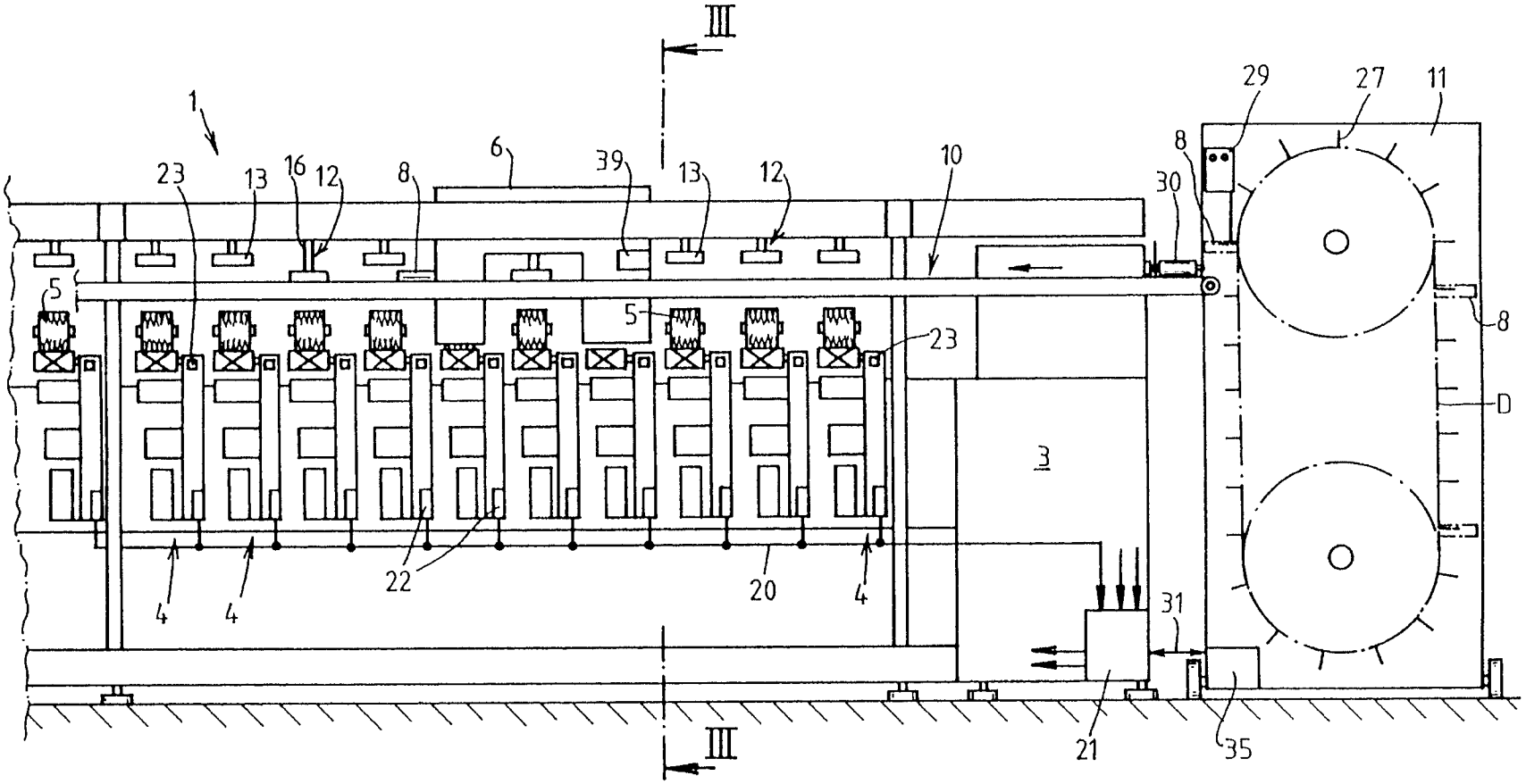
Fig. 1 is a front elevational view of a bobbin winding machine with a traveling servicing device as well as a tube conveyor arrangement extending over the length of the machine.

A bobbin winding machine in accordance with the present invention, identified as a whole by the reference numeral 1, is shown in a schematic front elevational view in FIG. 1. Such bobbin winding machines 1 typically have a plurality of identical winding stations 4 arranged in alignment with one another along the length of the machine between its opposite end frames 2 and 3. Spinning cops produced on a ring spinning frame (not shown) are rewound to larger-volume cheeses 5 at these winding stations, which is known and therefore not explained in detail herein.

The finished cheeses 5 are pushed onto a cheese conveying belt 7 (FIGS. 2 and 3 ) by an automatically operating servicing device, for example by means of a cheese changer 6, and are transported to a bobbin loading station (not shown) or a like discharge location, disposed at the end of the machine.

The cheese changer 6 continuously travels lengthwise along the machine above the winding stations 4, not only to ensure that the cheeses 5 finished at the winding stations 4 are pushed outward onto the conveyor belt 7, but also to automatically place a new empty tube 8 into the respective winding station 4. In the present winder, the cheese changer 6 takes the appropriate empty tube 8 from an intermediate storage device 9 (FIGS. 2 and 3 ) which is part of each winding station and is connected with an empty tube magazine 11 disposed at the end of the bobbin winding machine by means of a conveyor 10 extending along the length of the machine.

Figure 2:
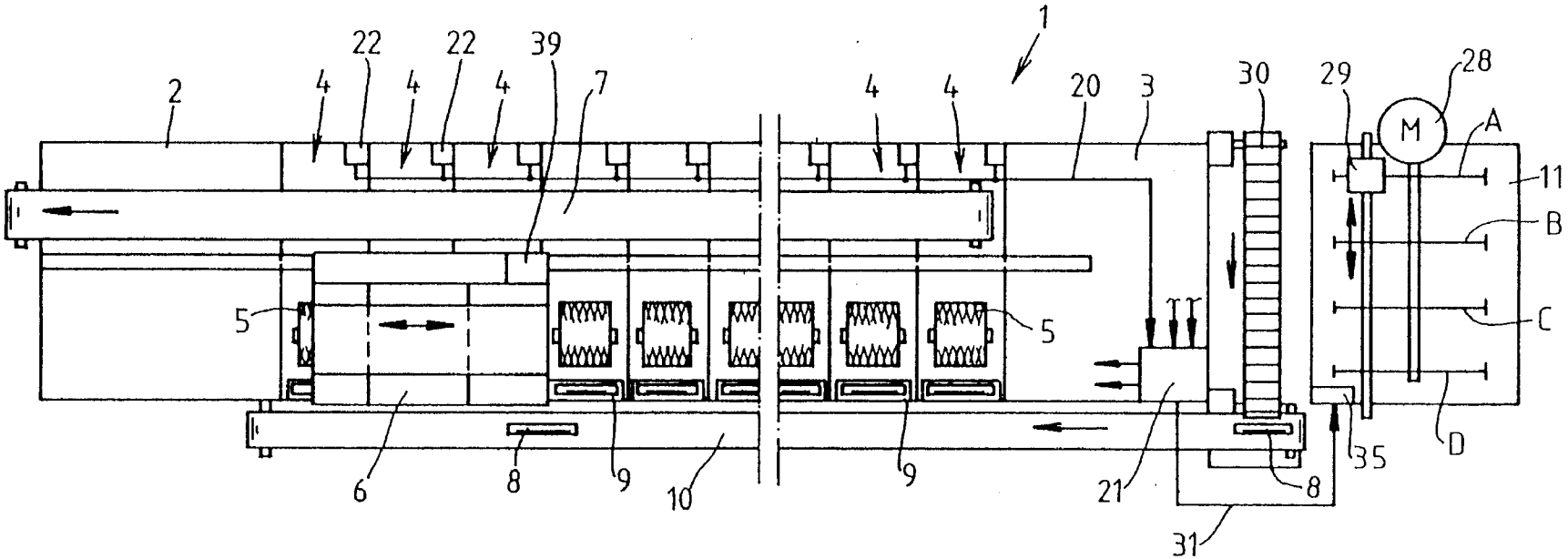
FIG. 2 is a top plan view of the winding machine of FIG. 1.

The empty tube magazine indicated in FIGS. 1 and 2 and identified as a whole by 11 has several storage chains A, B, C, D, etc. disposed next to each other, which have tube holding arbors 27 for supporting empty tubes 8. The storage chains can be actuated in a defined manner either via separate respective drives or by a common drive and interposed coupling elements. However, in a preferred embodiment the storage chains A, B, C, D have a common drive 28 and circulate together. The transfer of a tube 8 to the storage device 9 of a winding station takes place in this case by means of a tube ejecting device 29 disposed on the tube magazine 11. The tube ejecting device 29 can be moved transversely in respect to the storage chains for positioning at a respective storage chain A, B, C, or D to transfer the requested tube to an intermediate conveyor 30 which, for example, may have pocket-like receptacles for transporting tubes 8 (see FIG. 2). The intermediate conveyor 30 in turn conveys the tube 8 to the conveying device 10 extending along the machine. As is shown in FIG. 1, the tube magazine 11 can have its own control device 35, which is connected via a control line 31 with a central control device 21 of the automatic bobbin winder 1.

Figure 3:
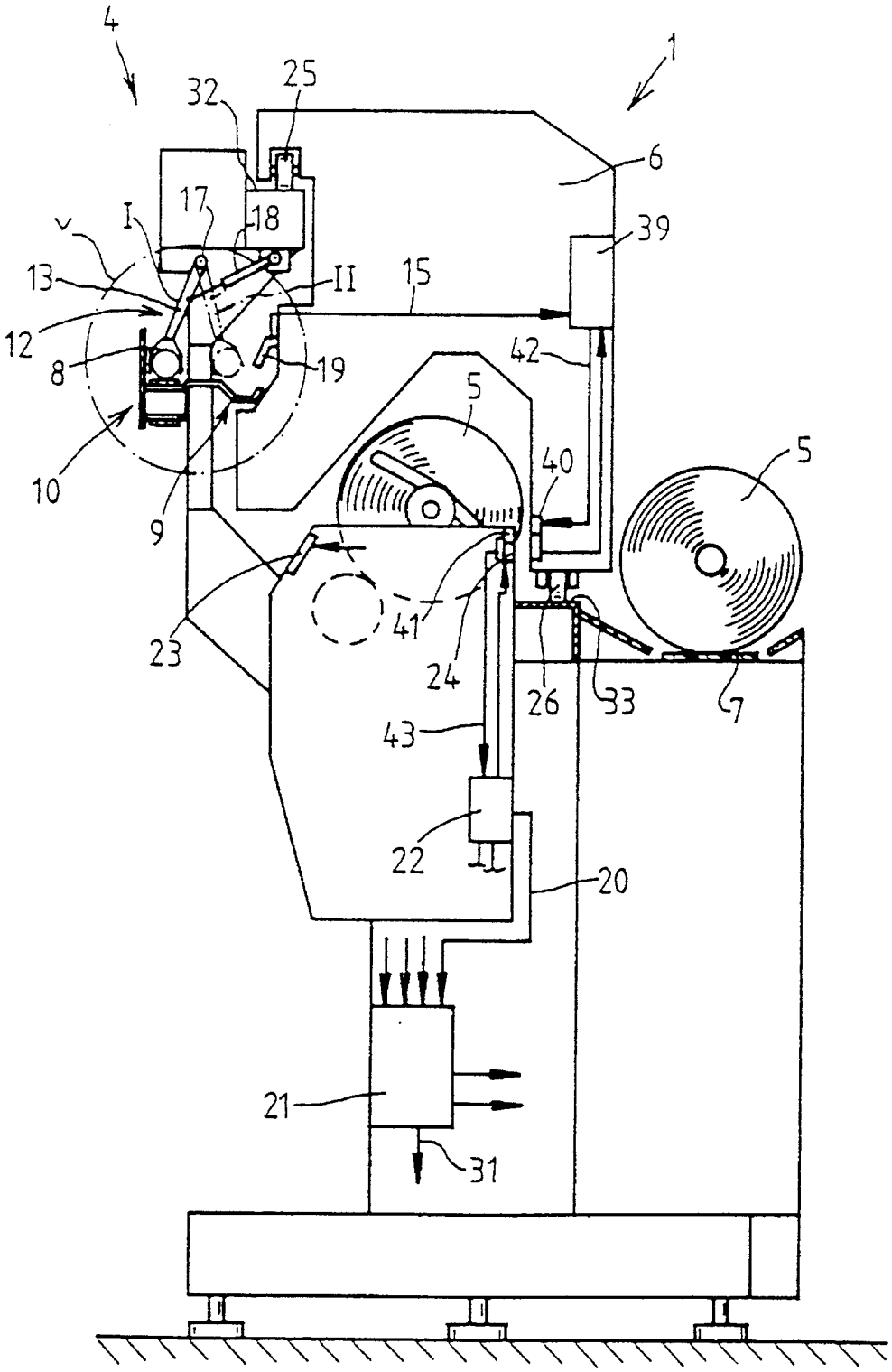
FIG. 3 is a vertical cross-sectional view of the bobbin winding machine of FIGS. 1 and 2 taken along the section line III—III of FIG. 1.
Figure 5:
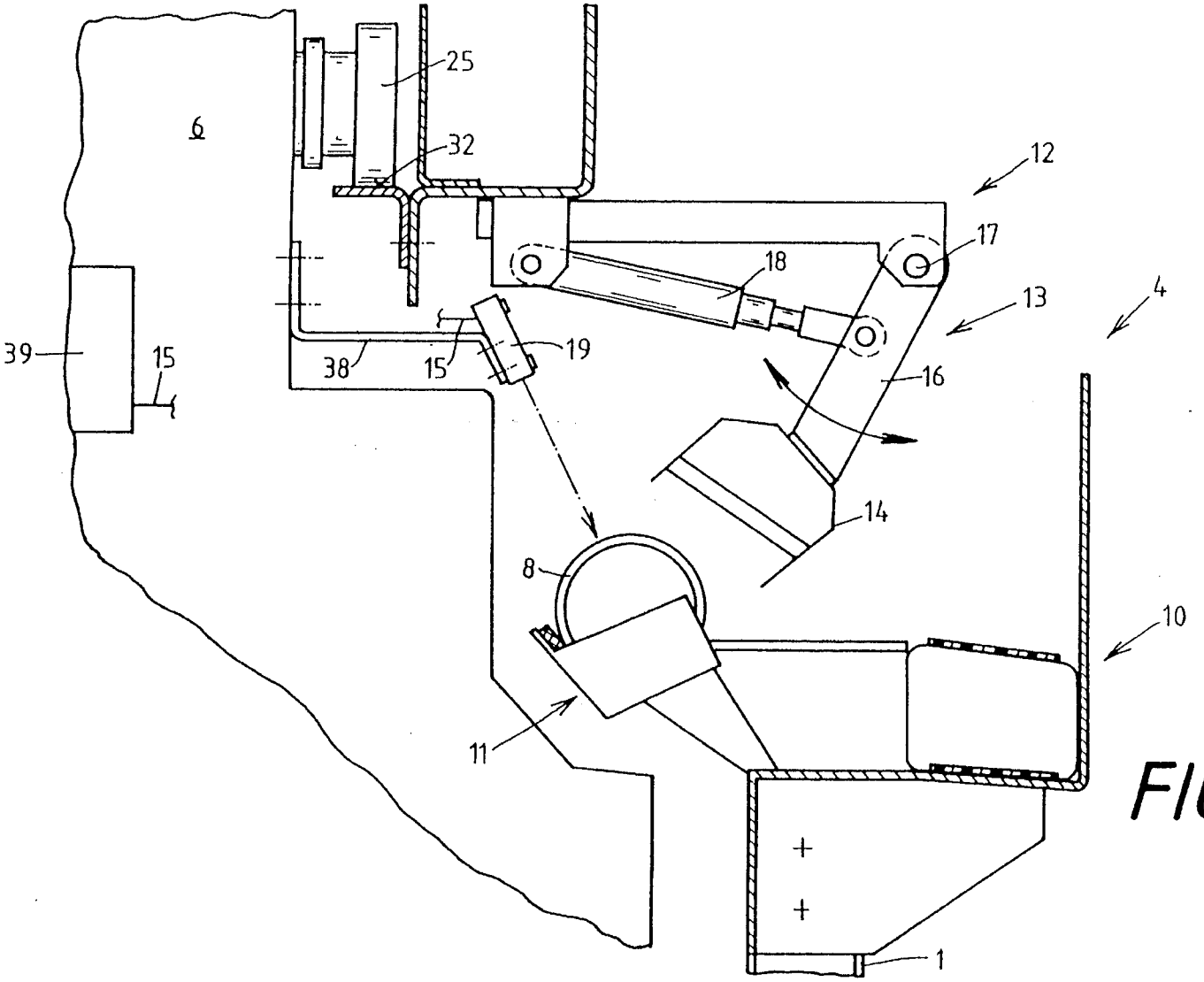
FIG. 5 is a partial vertical cross-sectional view also taken along line III—III showing the area V of FIG. 3 on an enlarged scale.

As indicated in FIG. 3 and illustrated on an enlarged scale in FIG. 5, a tube manipulating device 12 is disposed at each winding station 4 and is equipped with a tube gripper 13 which can be pivoted in a defined manner between a tube pick-up position I, shown in full lines in FIG. 3, in the area of the conveying device 10 and a tube release position II, shown in broken lines in FIG. 3, in the area of the intermediate storage device 9. The tube gripper 13 has a tube receiving pocket 14 fastened on a support arm 16 which is seated so it is movable around a pivot shaft 17. A drive means, e.g., a pneumatic thrust piston drive 18 in the exemplary embodiment as shown, acts on the support arm 16 to control its movement. The defined control of the thrust piston drive 18 is preferably performed by means of an electro-mechanically chargeable 5/2-way valve.

The tube storage state of the intermediate storage devices 9 of the winding stations is monitored by a sensor system 19 disposed on the traveling servicing device 6 to be movable therewith along the winding stations 4. The sensor system 19, which is preferably embodied as a light scanner, is connected to a control device 39 of the cheese changer 6 which in turn is connected with transmitting magnets 40 to send the data detected by the sensor system 19 in a contactless manner to a receiving sensor device 41 of each winding station 4, as appropriate. The receiving sensor devices 41 are disposed at the rear of the winding stations and each is in turn connected with a respective computer 22 at each winding station connected via a common signal line 20 with the central computer unit 21 of the bobbin winding machine 1.

The apparatus in accordance with the present invention operates as follows. The cheese changer 6 is movably supported by means of a running gear 25,26 on tracks 32,33 disposed to extend lengthwise along bobbin winding machine 1 above and/or behind the winding stations 4 and automatically travels back and forth along the machine to continuously monitor all winding stations 4.

Figure 4:
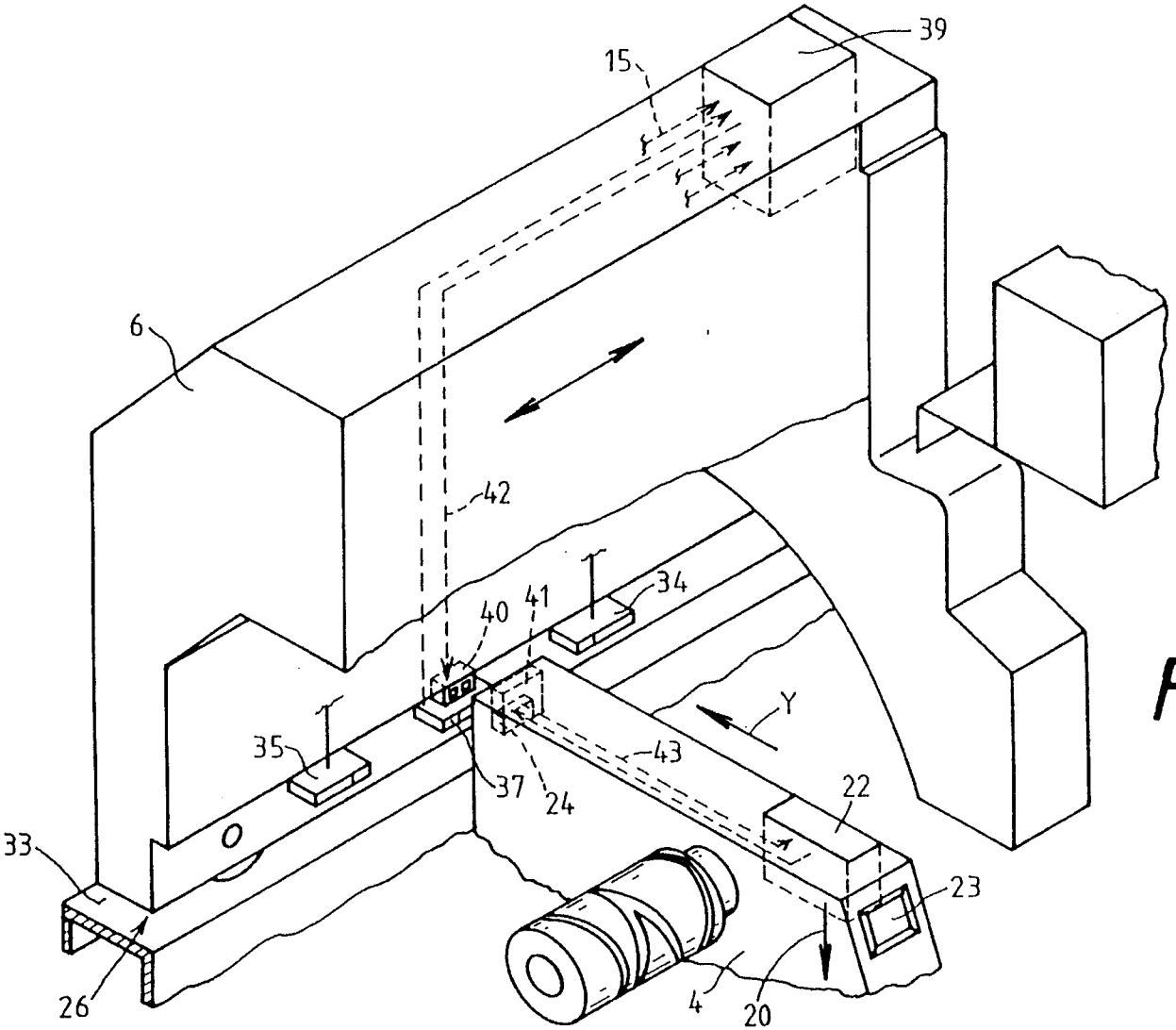
FIG. 4 is a perspective view in partial section of the traveling servicing device of the winding machine of FIGS. 1–3 shown approaching a winding station thereof.
Figure 6:
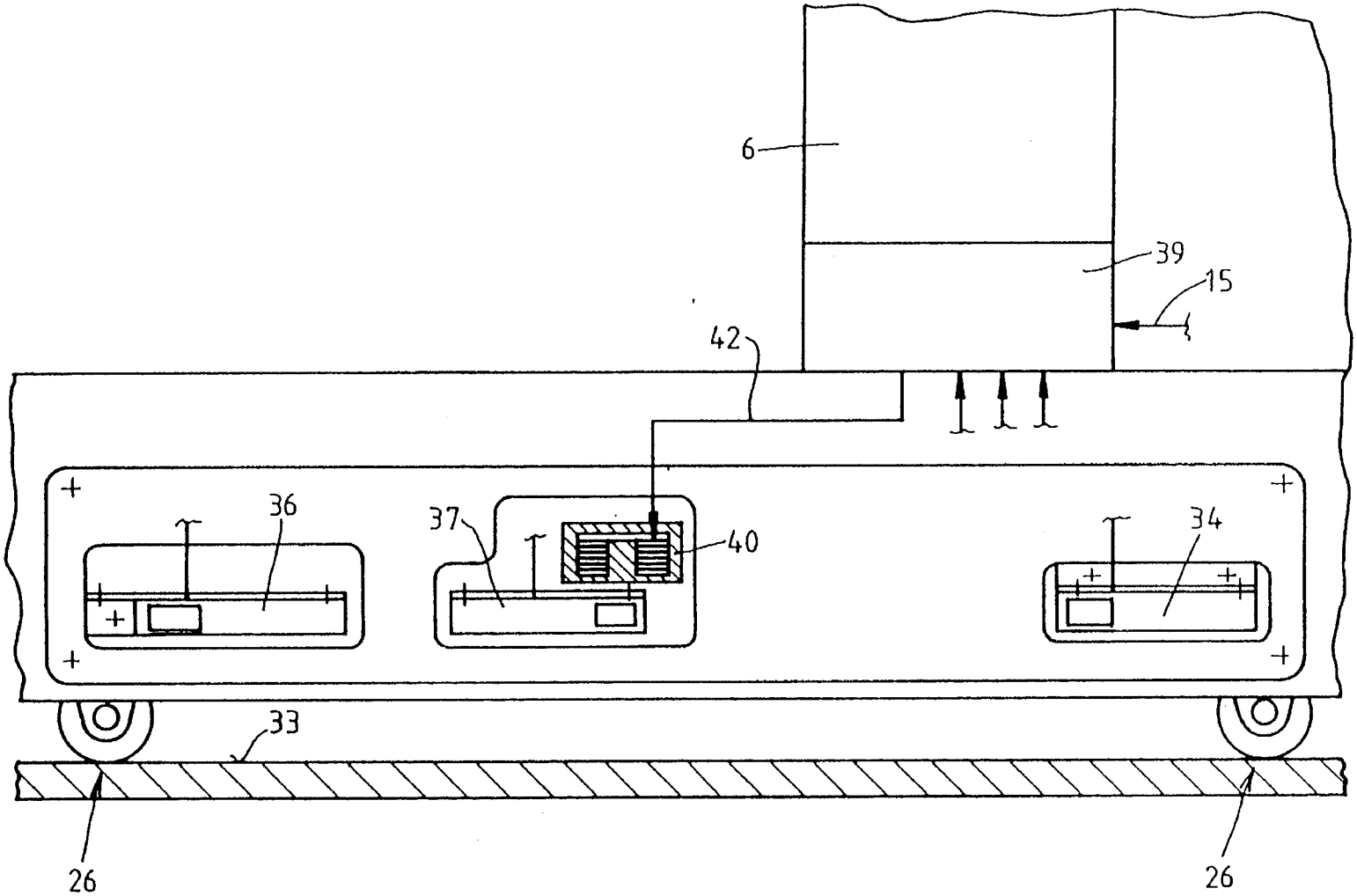
FIG. 6 is an elevational view of the servicing device of the present invention taken along the arrow Y of FIG. 4.
Figure 7:
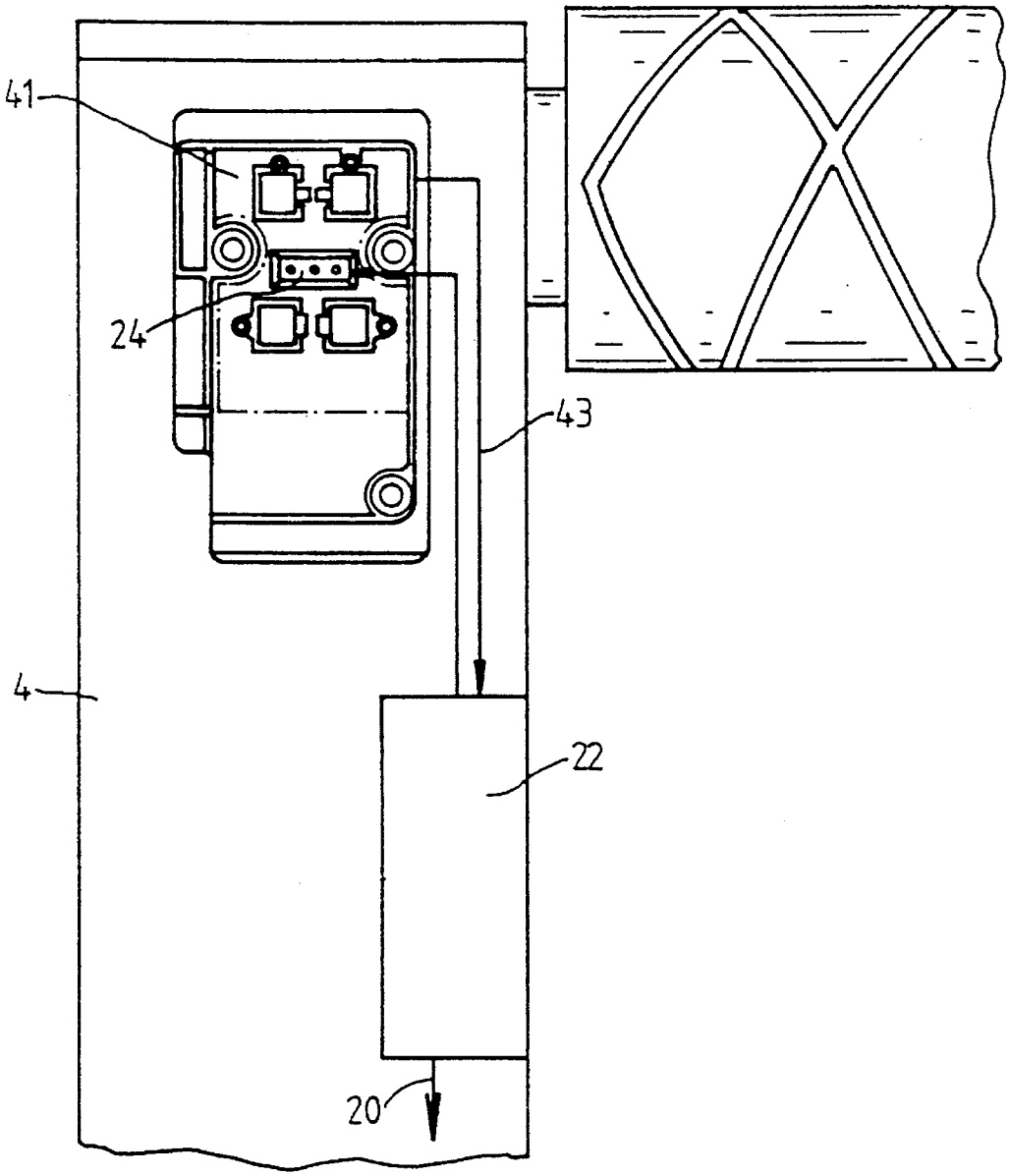
FIG. 7 is a rear elevational view of one winding station of the winding machine showing the infrared transmitting unit and the receiving sensor system.

As soon as a cheese in a winding station 4 has attained its preset diameter, the respective winding station is customarily shut down by a length or diameter-sensing stop motion. The disabled state of the winding station is signaled to the operator by actuation of a color-coded light 23 (e.g., yellow) and is also signaled to the automatically operating cheese changer 6 by means of an infrared transmitter unit 24 associated with the respective winding station (FIG. 3 ). The signal transmitted by the infrared transmitter unit 24 is of a defined frequency which can be identified by the infrared receivers 34,36,37 disposed on the servicing device 6 (FIGS. 4 and 6). When the cheese changer 6 moves to the appropriate winding station from the right or the let side, it first receives the infrared transmission from the transmitter unit 24 of the winding station with its right infrared receiver 34 or its lea infrared receiver 36 and thereupon reduces its speed to complete the approach of the cheese changer 6 to the winding station at a creep speed until the center infrared receiver 37 detects the infrared light of the respective winding station. The empty tube sensor system 19 disposed on the cheese changer 6 by means of the supporting angle bracket 38 simultaneously scans the fill state of the associated intermediate tube storage device 9 of the winding station. If the sensor system 19 detects the absence of a tube 8 in the intermediate storage device 9, this negative fill state of the intermediate storage device 9 is transmitted via the control device 39 of the cheese changer or via the transmitting magnets 40 connected to the control device 39 to a receiving sensor device 41 disposed on the winding station 4. In either case, the transmission from the mobile servicing device 6 to the stationary winding station 4 takes place in a contactless manner, preferably inductively.

If, for example, the sensor system 19 has detected that there is no tube 8 in the intermediate storage device 9 of the respective winding station 4 and that therefore an automatic cheese change cannot take place, the traveling mode of the cheese changer 6 is switched back from creep speed to the normal traveling mode. At the same time, a signal is transmitted via the transmitting magnets 40 to the inductive receiving sensor device 41 of the winding station 4 and is evaluated by its winding station computer 22 as a signal for requesting an empty tube 8. The winding station computer 22 forwards the appropriate information, which is provided with the appropriate winding station identification, to the central computer unit 21 of the bobbin winding machine 1. The central computer unit 21 accordingly triggers the control device 35 of the empty tube magazine 11. The appropriate signal, signifying for example "empty tube for winding station XYZ," is sent via the signal line 31 to the central tube magazine 11, which in the illustrated embodiment is disposed at the end of the bobbin winding machine and accordingly initiates appropriate action of the storage chains A to D equipped with stored tubes 8 on their tube holding arbors 27 to turn by means of the drive element 28 into a position in which the tube ejecting device 29 can be transversely moved between the storage chains to take a tube corresponding to the request from the storage chain and transfer it to the intermediate conveyor 30. The tube 8 is transferred by the intermediate conveyor 30 to the conveyor 10 extending lengthwise along the machine and is transported to the area of the winding station XYZ. At the appropriate winding station XYZ, where the empty intermediate storage device 9 had been detected, the tube manipulating device 12 is actuated to pivot the tube gripper 13 by means of the pneumatic thrust piston drive 18 into the tube receiving position I in the area of the conveying path of the tube conveying device 10. The timing of the actuation of pivoting the tube gripper is preferably selected as a function of the length of the tube transporting path along the conveyor 30, wherein the calculated tube transport time, for example the length of time from the moment of the tube transfer by the tube-ejecting device 29 of the tube magazine 11 to the intermediate conveying device 30 until the estimated arrival of the tube at the respective winding station XYZ, less a small safety reserve, can be used. For pivoting the tube gripper 13, the thrust piston drive 18 may be triggered via an electro-magnetic directional control valve by the winding station computer 22 or the control device 35 of the empty tube magazine, for example.

If, in the course of approaching a winding station 4, the sensor system 19 detects that an empty tube 8 has been deposited in the intermediate storage device 9, the cheese changer 6 is stopped at the winding station which has signaled a bobbin change in the centered position determined by the receiver 37 and the automatic device for changing the cheese is actuated. In this cheese changing cycle which is known and therefore need not be explained in detail herein, the servicing device replaces the finished cheese 5 by an empty tube 8 from the winding station's intermediate storage device 9. In the process the servicing device 6 takes the tube 8 out of the intermediate storage device 9 of the winding station and places it into the bobbin holder of the winding station 4 after having applied a reserve winding of yarn. At the termination of the change cycle, the cheese changer 6 leaves the winding station and continues its inspection travel along the machine.

During the cheese exchange process, the sensor system 19 of the cheese changer 6 continuously scanned the intermediate storage device 9 of the winding station to detect removal of the tube 8 by the gripper of the cheese changer 6 and thereupon forwarded a signal inductively via the control device 39 or the transmitting magnets 40 to the receiving sensor device 41 of the respective winding station. The winding station computer 22 of the respective winding station in turn considers the appropriate signal to be a request for an empty tube and signals the central computer 21 of the bobbin winding machine accordingly. As already explained above, the central computer 21 is connected with the control device 35 of the empty tube magazine 11 to initiate the supply of an empty tube.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A textile machine for producing cheeses, comprising:

a plurality of winding work stations, each equipped with an empty tube storage location and a controller, a traveling servicing device movable along the work stations and having means for automatically exchanging finished cheeses with empty tubes, a tube storage magazine, a conveyor extending lengthwise along the machine for transporting tubes to the work stations supplied by the servicing device, and a central control unit, wherein the traveling servicing device includes a contactless sensor means for monitoring the fill state of the empty tube storage location at each work station and a signal transmitter connected to said sensor means for transmitting to the controller of each work station an information signal representing the fill state of the empty tube storage location of the respective work station, each said controller including means responsive to the signal transmitter for transmitting to the central control unit a request signal representing a request for delivery of an empty tube and identifying the respective work station for delivery when the information signal transmitted to the controller indicates the absence of an empty tube at the respective empty tube storage location.

2. A cheese-producing textile machine in accordance with claim 1, wherein the sensor means comprises a light scanner connected with the traveling servicing device.

3. A cheese-producing textile machine in accordance with claim 1, wherein the signal transmitter comprises a transmitting magnet disposed on the servicing device and the responsive means of each controller includes a receiving sensor device disposed on the respective work station for transmitting signals inductively therebetween.

4. A cheese-producing textile machine in accordance with claim 1, wherein the empty tube magazine includes a control device and the central control unit is connected therewith for actuation of delivery of a replacement empty tube to a work station from which a request signal has been received.

5. A cheese-producing textile machine in accordance with claim 1, wherein the servicing device has a control device connected with the signal transmitter to be operative to disable the tube exchanging means of the servicing device when the absence of an empty tube at the empty tube storage location of the work station is signaled by the signal transmitter.

* * * * *